US008454251B2

(12) United States Patent
Bhatia et al.

(10) Patent No.: US 8,454,251 B2
(45) Date of Patent: Jun. 4, 2013

(54) PRINTER BRACKET

(75) Inventors: Chandrakant Bhatia, Libertyville, IL (US); David Haas, Schaumburg, IL (US); Carlos Medina, Harvard, IL (US)

(73) Assignee: Videojet Technologies Inc.

( * ) Notice: Subject to any disclaimer, the term of this patent is extended or adjusted under 35 U.S.C. 154(b) by 304 days.

(21) Appl. No.: 13/063,780

(22) PCT Filed: Sep. 25, 2009

(86) PCT No.: PCT/US2009/058369
§ 371 (c)(1),
(2), (4) Date: Mar. 14, 2011

(87) PCT Pub. No.: WO2010/036888
PCT Pub. Date: Apr. 1, 2010

(65) Prior Publication Data

US 2011/0170932 A1 Jul. 14, 2011

Related U.S. Application Data

(60) Provisional application No. 61/100,126, filed on Sep. 25, 2008.

(51) Int. Cl.

| | |
|---|---|
| ***B41J 29/02*** | (2006.01) |
| ***B41J 29/12*** | (2006.01) |
| ***B41J 29/13*** | (2006.01) |
| ***B41J 11/06*** | (2006.01) |
| ***B41J 15/04*** | (2006.01) |

(52) U.S. Cl.
USPC ..... 400/48; 400/149; 400/611; 400/649; 400/691

(58) Field of Classification Search
CPC ..... B41J 29/026
USPC ..... 400/691, 693, 613, 149, 48, 611, 400/649, 656; 347/2, 108, 173, 222
See application file for complete search history.

(56) References Cited

U.S. PATENT DOCUMENTS

| | | | | |
|---|---|---|---|---|
| 4,611,940 | A * | 9/1986 | Takenoya et al. | 400/649 |
| 4,651,173 | A * | 3/1987 | Ozawa et al. | 346/136 |
| 4,857,943 | A * | 8/1989 | Yoshimura et al. | 346/136 |
| 5,208,612 | A * | 5/1993 | Obu et al. | 347/152 |
| 5,447,380 | A | 9/1995 | Colonel | |
| 5,791,796 | A | 8/1998 | Gustavsson | |
| 2001/0043828 | A1 | 11/2001 | Mahoney | |
| 2005/0271449 | A1 | 12/2005 | Hirte | |

FOREIGN PATENT DOCUMENTS

| | | | |
|---|---|---|---|
| JP | 08048047 | A * | 2/1996 |
| JP | 2005265979 | A * | 9/2005 |

* cited by examiner

*Primary Examiner* — Daniel J Colilla
(74) *Attorney, Agent, or Firm* — Joseph A. Yosick

(57) ABSTRACT

A bracket for a printer includes a frame with first and second side supports. A print area is defined in part by the side supports. A plurality of web support members laterally extends between the first and second side supports. The plurality of web support members include a top web support member disposed adjacent a top portion of the print area and a bottom web support member disposed adjacent a bottom portion of the print area. A printer support is configured for supporting a printer adjacent the print area. A window assembly is hingedly attached to the frame adjacent the print area. The window assembly includes a platen support member extending laterally between the first and second side supports. The window assembly is movable to provide access to the print area. At least one platen is disposed on the platen support member, the platen adapted for lateral positioning along the platen support member.

17 Claims, 6 Drawing Sheets

PRINTER BRACKET

RELATED APPLICATIONS

This application claims priority under 35 U.S.C. §371 from PCT Application No. PCT/US2009/058369, filed in English on Sep. 25, 2009, which claims the benefit of U.S. Provisional Application No. 61/100,126 filed Sep. 25, 2008, the disclosures of both of which are incorporated herein be reference in their entireties.

BACKGROUND OF THE INVENTION

Certain printers, such as thermal transfer overprinters (TTO printers) or hot stamp printers, are used to print code or other images on a web material. In typical arrangements, a frame is used. The frame creates a cage-like bracket and one or two printers are typically mounted in the bracket. For maintenance purposes, the cassette of the printer must be removed to change the ribbon. Because there is little room in the cage and the cassette is relatively large, it is very difficult to remove and reinstall the cassette.

BRIEF SUMMARY OF THE INVENTION

The invention provides a hinged structure that opens up the side of a printer bracket to allow easy removal and replacement of a printer cassette.

In an embodiment, a bracket for a printer includes a frame with first and second side supports. A print area is defined in part by the side supports. A plurality of web support members laterally extends between the first and second side supports. The plurality of web support members include a top web support member disposed adjacent a top portion of the print area and a bottom web support member disposed adjacent a bottom portion of the print area. A printer support is configured for supporting a printer adjacent the print area. A window assembly is hingedly attached to the frame adjacent the print area. The window assembly includes a platen support member extending laterally between the first and second side supports. The window assembly is movable to provide access to the print area. At least one platen is disposed on the platen support member, the platen adapted for lateral positioning along the platen support member.

In another embodiment, a method of servicing the print head of a printer includes providing a bracket for a printer. The bracket includes a frame including first and second side supports. A print area is defined in part by the side walls. A plurality of rollers laterally extends between the first and second side supports. The plurality of rollers includes a top roller disposed adjacent a top portion of the print area and a bottom roller disposed adjacent a bottom portion of the print area. A window assembly is attached to the frame adjacent the print area. The window assembly includes rods extending laterally between the first and second side supports. At least one print surface is disposed on the rods. The window assembly is unfastened from the frame. The window assembly is moved with respect to the frame to provide access to the print area. A printer disposed adjacent the print area is accessed and the printer is serviced. The window assembly is then fastened to the frame.

DETAILED DESCRIPTION OF THE INVENTION

The present disclosure provides a hinged structure that opens up the side of a printer bracket to allow easy removal and replacement of a printer cassette.

Figure 1:
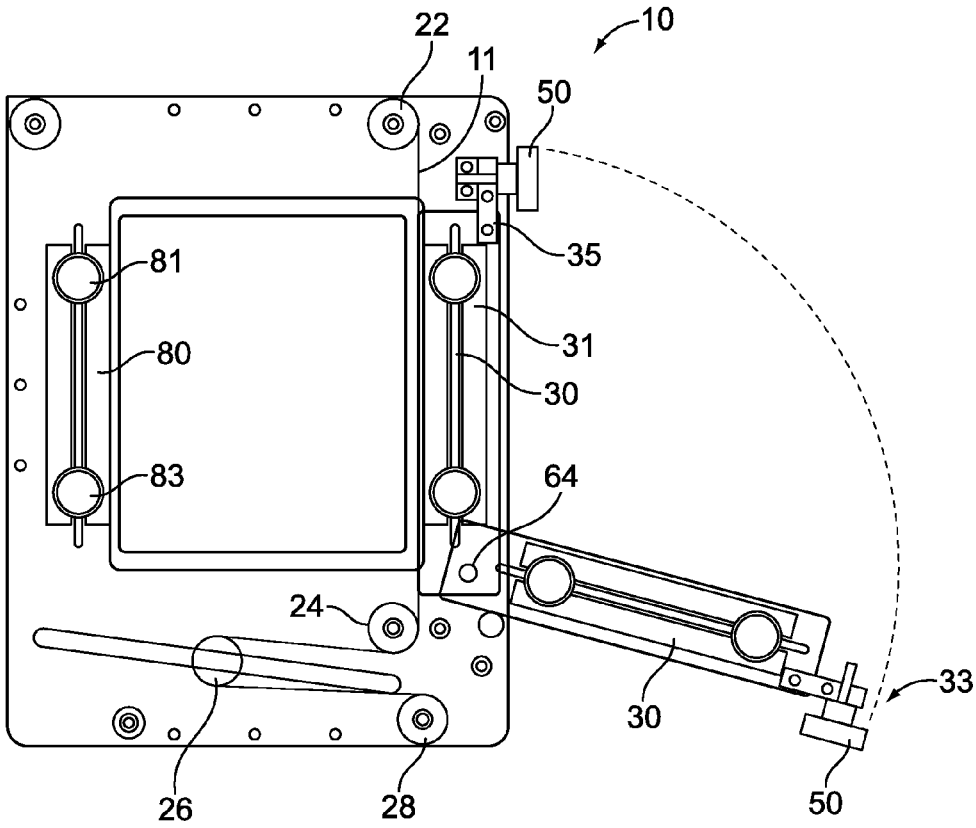
FIG. 1 is a side schematic view of an embodiment of a bracket showing a window assembly in both closed and open positions.
Figure 2:
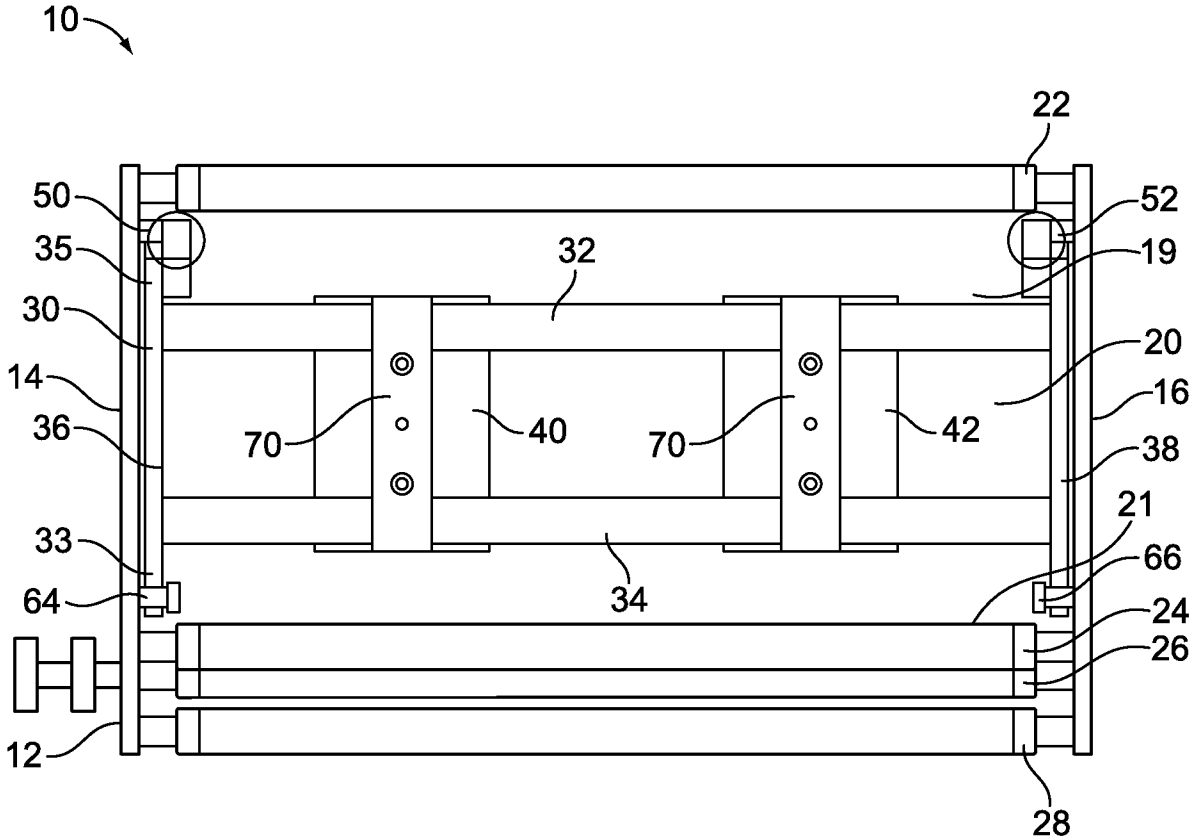
FIG. 2 is a front view of the bracket of FIG. 1 in a closed position.

FIG. 1 is a side schematic view of an embodiment of a bracket for a printer showing a window assembly 30 in both closed 31 and open 33 positions. As best seen in FIG. 2, a bracket 10 for a printer includes a frame 12 with a first side support 14 and a second side support 16. A print area 20 is defined in part by the side supports 14, 16. The first and second side supports 14, 16 are preferably generally parallel to each other. The print area 20 includes the area in which a printer or print head applies an image to a substrate. Web support members 22, 24, 26, 28, which may be rollers, laterally extend between support 14 and support 16. A top roller 22 is disposed adjacent a top portion 19 of the print area 20 and a bottom roller 24 is disposed adjacent a bottom portion 21 of the print area 20. A web 11, which may be, for example, a plastic film to be printed upon, snakes around web support members 22, 24, 26, and 28, as best seen in FIG. 1. A printer cassette, as will be described in more detail below, is configured to print an image upon the web 11.

The window assembly 30 is hingedly attached to the frame 12 adjacent the print area 20. The window assembly includes side supports 36, 38, which, when the window assembly 30 is in the closed position, are disposed adjacent bracket side supports 14, 16. The window assembly 30 includes a top platen support member or rod 32 and bottom platen support member or rod 34 extending laterally between the support 36 and support 38. As shown in FIG. 1, the window assembly 30 is movable between a closed position 31 and an open position 33 to provide access to the print area 20. The window assembly 30 is configured so that it may be opened and closed with the web 11 remaining disposed in place on the rollers. Thus, the print head may be serviced without removing or disrupting the web.

Certain types of printers, such as TTO printers, use a print surface on the opposite side of the web (or other substrate) from the print head. The print head pushes the substrate against the print surface to provide an image in the substrate. In some applications, a platen is used as a print surface. A first platen 40, and preferably a second platen 42, may be disposed on a platen support member, such as rods 32, 34. Besides rods, other structural members may be used as platen support members. One rod, or more than two rods, may also be used. Platens 40, 42 are adapted to be laterally positioned along the platen support members, which may be rods 32, 34. Rods 32, 34 may be cylindrical in shape, or any other suitable shape. The platens 40, 42 are used to provide a firm surface against which the print head to press the material being printed upon.

In place of the platens 40, 42, a different surface, such as a curved surface such as a roller (not shown), may be used. In particular, for a continuous printing process (wherein the substrate does not stop, but moves continuously), a curved surface is the preferred print surface. Other suitable print surfaces are possible depending on the desired application.

A fastener 50 is disposed at a top portion 35 of the window assembly 30 for securing the window assembly 30 to the frame 12. As best seen in FIG. 2, fastener 50 may be disposed on one side of the window assembly 30 at side support 36, with another fastener 52 on the other side of the window assembly 30 at side support 38. In on embodiment, fastener 50 includes a screw portion and a handle and is configured to be screwed into a hole in tab 60 attached to frame 12. Other configurations for a fastener are possible.

A hinge 64 may be disposed on a lower portion of the window assembly 30. The hinge 64 may be of any suitable design. The bracket 10 may include a first hinge 64 on one side and a second hinge 66 on the other side. In one embodiment, the hinge 64 includes a cylindrical member (such as a bolt) fastened to the window assembly 30 and disposed in an opening in the frame 12, preferably in supports 14, 16. Other types of hinges are possible. For example, the window assembly 30 may be connected to the frame 12 by a piano hinge, barrel hinge, pivot hinge, integral hinge, or any other suitable type of hinge.

As best seen in FIG. 1, the window assembly 30 rotates downward from a generally vertical position 31 to a generally horizontal position 33 to provide access to the print area 20. Other configurations of the window assembly 30 are also possible, such as rotating upward along a horizontal axis, or rotating sideways along a vertical axis. Stops 68, 69 are disposed in the frame 12 in side supports 14, 16 to provide a surface upon which the window assembly 30 may rest against when the window assembly is in the open position 33. In an alternative embodiment, the window assembly 30 may be completely detached from the frame 12 to provide access to the printers, instead of retaining a hinged connection.

Additionally, the window assembly 30 may include a fastener 70 for securing the platens 40, 42 to the rods 32, 34. Preferably the fastener 70 includes a clamp-like device that allows the platens 40, 42 to be loosened and secured to the rods 32, 34 to allow adjustment of the platens 40, 42 in a lateral position along the rods 32, 34.

Figure 3:
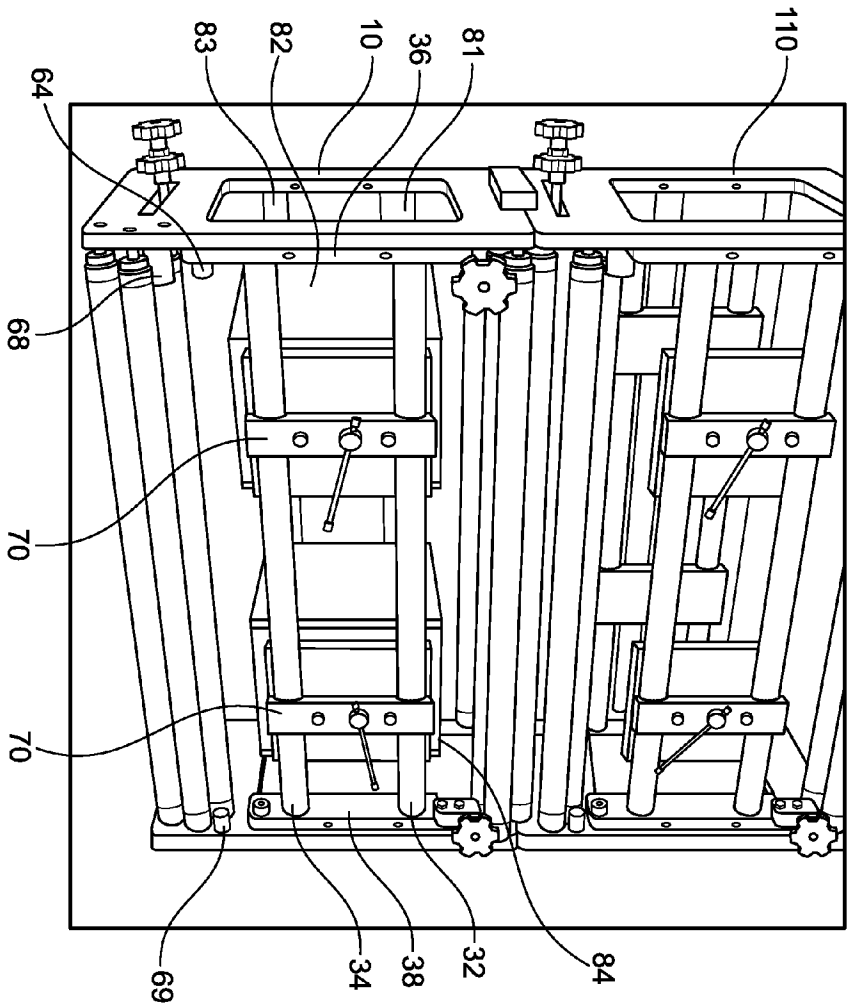
FIG. 3 is a perspective view of another embodiment of a bracket in a closed position.
Figure 4:
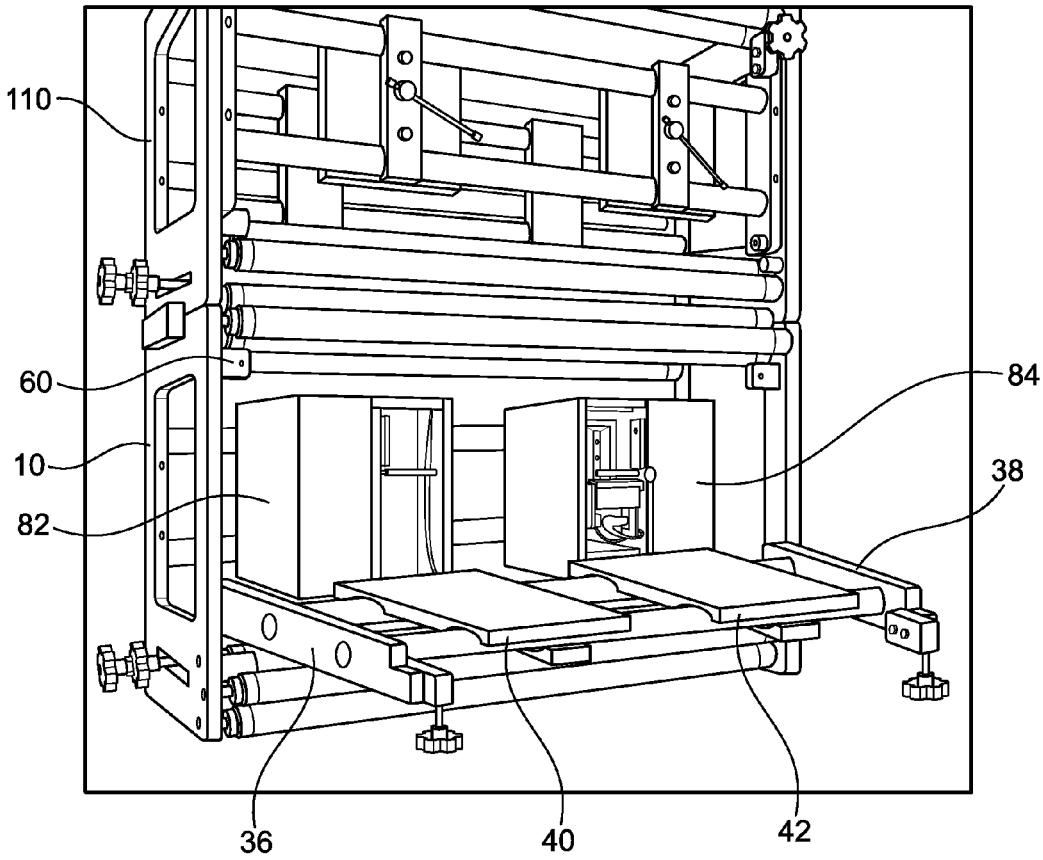
FIG. 4 is a perspective view of the bracket of FIG. 3 in an open position.

As best seen in FIGS. 1 and 3, a printer support 80 is configured for supporting a printer 82 adjacent the print area 20. A printer 82 is secured to the printer support 80 and disposed adjacent the print area 20. The printer support 80 may include rods 81, 83, which may be similar in construction and use as rods 32, 34. Rods 81, 83 allow the printers 82, 84 to be adjusted in the lateral direction. The printer 82 is disposed adjacent the platen 40 at a distance between the platen 40 and the print head within the printer 82 of less than 5 mm, generally around 3 to 4 mm. The printer may include a TTO printer, such as a Videojet DataFlex® printer. As shown in FIG. 4, an additional printer 84 may also be disposed within the bracket 10, adjacent to platen 42. In an alternative embodiment, printers 82, 84 may be attached to the window assembly 30, with the corresponding print surface (such as platen 40 or a printing roller) disposed on the support 80 adjacent the print area 20 opposite the window assembly 30.

The bracket 10 may include any number of printers 82, from as few as one to three or more. In a typical configuration, the bracket 10 will include two printers. The number of platens, if used, will typically correspond to the number of printers.

Figure 5:
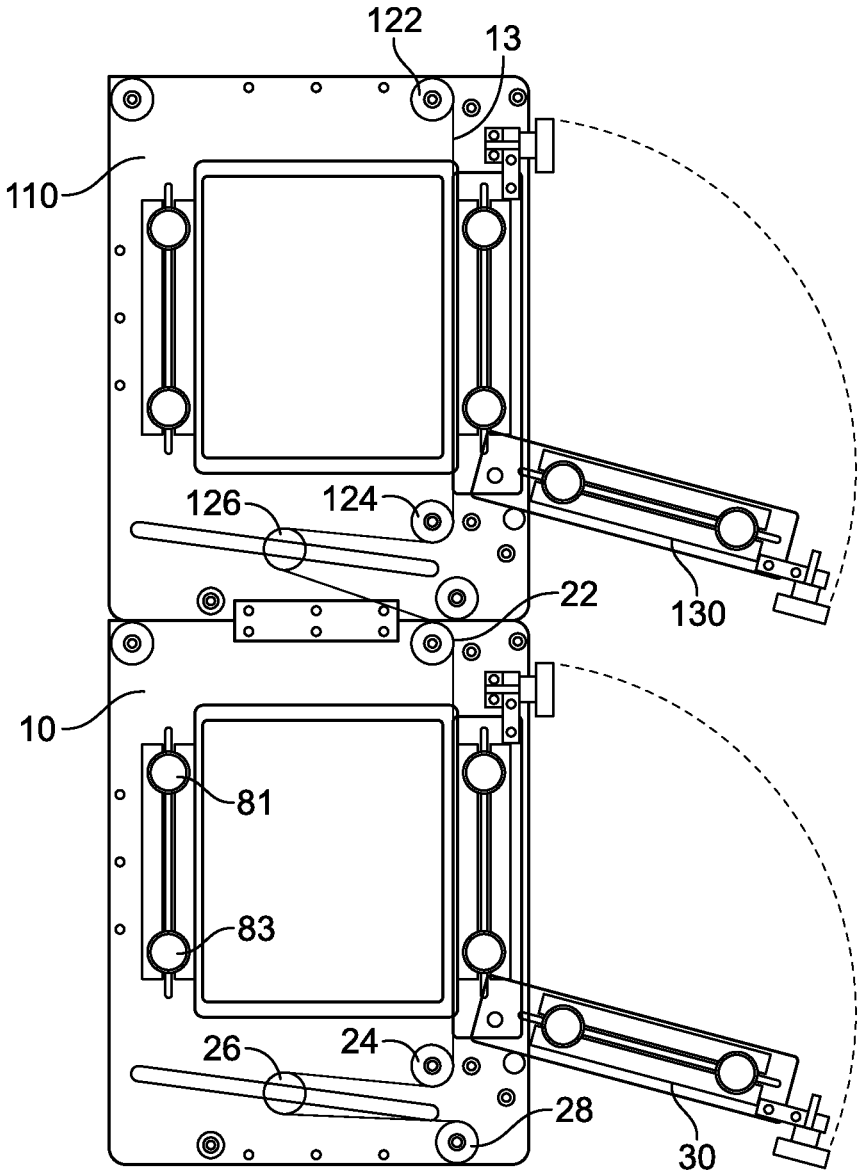
FIG. 5 is a side schematic view of an embodiment of a bracket showing a window assembly in both closed and open positions.
Figure 6:
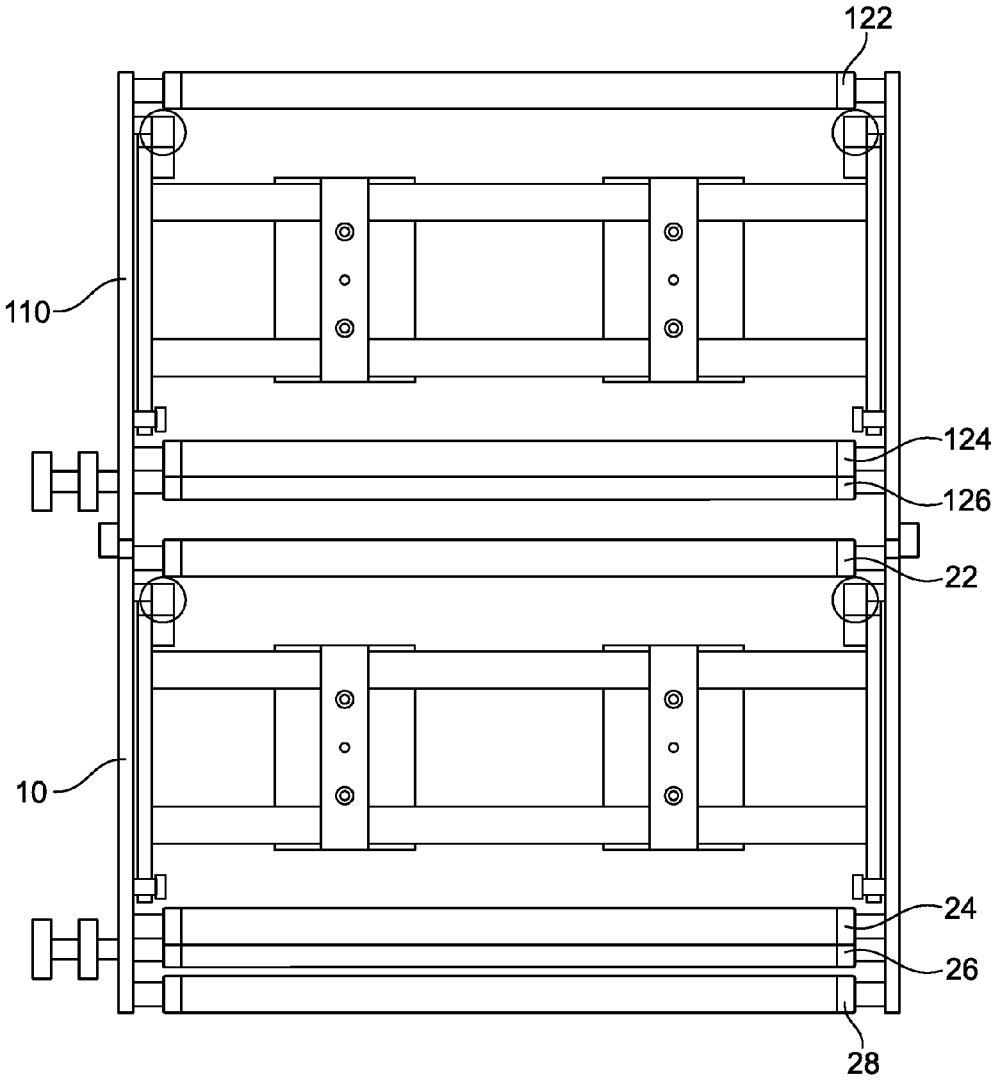
FIG. 6 is a front view of the bracket of FIG. 5 in a closed position.

In another embodiment, shown in FIGS. 3 to 6, a second bracket 110 may be disposed above the first bracket 10. Bracket 110 may be generally similar to the previously described bracket 10, with corresponding individual components. Certain features of the brackets 10, 110 may be integrated. For example, side supports 14, 16 may be integral pieces that support both brackets 10, 110. As best seen in FIG. 5, bracket 110 may include a web 13 running through rollers 122, 124, and 126 of a top bracket 110 and then into rollers 22, 24, 26, and 28 of the bottom bracket 10. One skilled in the art will appreciate that greater numbers of brackets may be assembled together for other applications.

In general dimensions, the bracket may be about 15 inches high, and about 12 inches deep, with a suitable width to accommodate the desired number of printers. Of course, the dimensions of the bracket are generally dependent upon the dimension of the printer to be used with the bracket. The window assembly may be about 10 inches tall, with a width slightly less than the width of the bracket itself. The various components of the bracket 10 may be constructed of any suitable material, including a suitable metal such as steel. The surfaces of the platens 40, 42 are typically constructed of rubber of a suitable hardness.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bracket for a printer, comprising:

a frame comprising first and second side supports;

a print area defined in part by the side supports;

a plurality of web support members laterally extending between the first and second side supports, the plurality of web support members including a top web support member disposed adjacent a top portion of the print area and a bottom web support member disposed adjacent a bottom portion of the print area;

a printer support configured for supporting a printer adjacent the print area;

a window assembly hingedly attached to the frame adjacent the print area, the window assembly comprising a platen support member extending laterally between the first and second side supports, wherein the window assembly is movable to provide access to the print area; and at least one platen disposed on the platen support member, the platen adapted for lateral positioning along the platen support member.

2. The bracket of claim 1, further comprising a fastener for securing the window assembly to the frame.

3. The bracket of claim 2 wherein the fastener is disposed at a top portion of the window assembly.

4. The bracket of claim 1 wherein the window assembly comprises two platen support members and two platens disposed on the two platen support members.

5. The bracket of claim 1 further comprising a hinge disposed on a lower portion of the window assembly.

6. The bracket of claim 5 wherein the hinge comprises a pin disposed in a hole in the first and second side supports.

7. The bracket of claim 5 wherein the window assembly rotates downward from a generally vertical position to a generally horizontal position to provide access to the print area.

8. The bracket of claim 1, further comprising a fastener for securing the at least one platen to the platen support member.

9. The bracket of claim 1, further comprising a printer secured to the printer support and disposed adjacent the print area.

10. The bracket of claim 9 wherein the printer is disposed adjacent a platen at a distance between the platen and the printer of less than 4 mm.

11. The bracket of claim 1 wherein a top portion of the window assembly is disposed adjacent the top web support member and a bottom portion of the window assembly is disposed adjacent the bottom web support member.

12. The bracket of claim 1 further comprising a second window bracket disposed above the first window bracket.

13. The bracket of claim 1 wherein the first and second side supports are generally parallel.

14. A method of servicing the print head of a printer, comprising:

providing a bracket for a printer, comprising:

a frame comprising first and second side supports;

a print area defined in part by the side supports;

a plurality of rollers laterally extending between the first and second side supports, the plurality of rollers including a top roller disposed adjacent a top portion of the print area and a bottom roller disposed adjacent a bottom portion of the print area;

a window assembly attached to the frame adjacent the print area, the window assembly comprising rods extending laterally between the first and second side supports; and at least one print surface disposed on the rods;

unfastening the window assembly from the frame;

moving the window assembly with respect to the frame to provide access to the print area;

accessing a printer disposed adjacent the print area;

servicing the printer; and fastening the window assembly to the frame.

15. The method of claim 14 wherein moving the window assembly with respect to the frame to provide access to the print area comprises rotating the window assembly with respect to a generally horizontal axis.

16. The method of claim 15 wherein moving the window assembly with respect to the frame to provide access to the print area further comprises rotating the window assembly from a generally vertical position to a generally horizontal position.

17. The method of claim 14 wherein unfastening the window assembly from the frame comprises rotating a fastener disposed on the window assembly to disengage the fastener from the frame.

* * * * *